US007279628B2

(12) United States Patent
Miyamoto et al.

(10) Patent No.: US 7,279,628 B2
(45) Date of Patent: Oct. 9, 2007

(54) EDITING APPARATUS OF SETTING INFORMATION FOR ELECTRONIC MUSIC APPARATUSES

(75) Inventors: Hiromu Miyamoto, Hamamatsu (JP); Kenichiro Saito, London (GB); Hideo Miyamori, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 168 days.

(21) Appl. No.: 10/943,440

(22) Filed: Sep. 17, 2004

(65) Prior Publication Data

US 2005/0066797 A1 Mar. 31, 2005

(30) Foreign Application Priority Data

Sep. 30, 2003 (JP) ..... 2003-339864

(51) Int. Cl.
*G10H 1/00* (2006.01)
*G10H 1/18* (2006.01)
*G10H 7/00* (2006.01)

(52) U.S. Cl. ..... 84/615; 84/601; 84/602; 84/653

(58) Field of Classification Search ..... None
See application file for complete search history.

(56) References Cited

U.S. PATENT DOCUMENTS 6,784,355 B2 * 8/2004 Gyoten et al. ..... 84/622
2003/0000368 A1 * 1/2003 Isozaki ..... 84/609
2003/0000369 A1 * 1/2003 Funaki ..... 84/609
2003/0024375 A1 * 2/2003 Sitrick ..... 84/477 R
2003/0066413 A1 * 4/2003 Nishitani et al. ..... 84/615
2003/0205125 A1 * 11/2003 Futamase et al. ..... 84/622
2004/0177745 A1 * 9/2004 Kayama ..... 84/609

FOREIGN PATENT DOCUMENTS

JP 11-212554 8/1999

* cited by examiner

*Primary Examiner*—Marlon Fletcher
(74) *Attorney, Agent, or Firm*—Morrison & Foerster LLP

(57) ABSTRACT

An electronic music apparatus has a tone generator settable by setting information to generate a music tone signal and an open memory area accessible for storing identification information of the electronic music apparatus and setting information specific to the electronic music apparatus. The electronic music apparatus reads out the identification information from the open memory area and sends the read identification information to an editing apparatus, and receives setting information from the editing apparatus and writes the received setting information into the open memory area. Further, when the setting information is written into the open memory area, the written setting information is applied to the tone generator. The editing apparatus has a storage for storing the edited setting information in association with the identification information of each electronic music apparatus. The editing apparatus receives the identification information sent from the electronic music apparatus, identifies the electronic music apparatus which sends the identification information, locates the setting information stored in the storage in association with the received identification information, and sends the located setting information to the identified electronic music apparatus.

5 Claims, 9 Drawing Sheets

EDITING APPARATUS OF SETTING INFORMATION FOR ELECTRONIC MUSIC APPARATUSES

BACKGROUND OF THE INVENTION

1. Technical Field

The present invention is related to a technology of applying setting information edited by an editing apparatus to electronic music apparatuses. A personal computer in which software programs are installed or another electronic music apparatus provides this editing apparatus.

2. Background Art

In electronic music apparatuses, play data are fed into a tone generator to generate a musical tone, effects are imparted by an effector to the generated musical tone, volume adjustment and mixing are executed on the effect-imparted musical tone by a sound system to generate mixed musical tones, and this mixed musical tones are sounded from a speaker of the sound system.

In this process, the tone generator, the effector, and the sound system generate musical tones on the basis of various kinds of setting information represented by various types and values of parameters such as timbre, effect, tempo, and volume (the types and values of parameters will hereafter be referred to simply as "parameters").

These various kinds of setting information may be edited by users in accordance with particular pieces of music or in accordance with each user's preference. The editing may also be executed in electronic music apparatuses. However, use of music application programs having editing capabilities in personal computers allows the use of a wide display monitor and easy-to-operate input devices such as keyboard and mouse, thereby significantly enhancing the efficiency of editing works.

To realize this high-efficiency editing, it is required to connect a personal computer which functions as an editing apparatus to one or more electronic music apparatuses to transfer edited setting information to these electronic music apparatuses.

The transfer of music data files and setting information files from one electronic music apparatus to another electronic music apparatus or from the personal computer to the electronic music apparatuses is conventionally executed by use of the file dump transfer based on "realtime universal exclusive message" of MIDI standard. However, the transfer rate based on the MIDI standard is slow and therefore it takes long time for even small-sized files to be transferred.

Recently, along the popularization of personal computers, electronic music apparatuses have come to use USB (Universal Serial Bus) interface having high transfer rates. However, the use of the USB interface requires the installation of dedicated drivers in personal computers and electronic music apparatuses to transfer data on the basis of dedicated protocols, thereby complicating the configuration of the associated software, which in turn lowers the substantial transfer rates.

On the other hand, recent personal computers allow direct access to flush memories incorporated in peripheral devices. For example, digital cameras have come to have the USB interface based on USB mass storage class. As for personal computers, their operating systems have become compliant with USB mass storage class on their part without necessity of installing new drivers.

Each of the above-mentioned flash memories is recognized on the personal computer side as an accessible drive. Hereafter, such a memory device equivalent to a conventional disk drive is referred to as an open drive. As a result, personal computers can access external flash memories incorporated in external devices as easily as internal flash memory incorporated in the personal computer themselves.

Therefore, the USB interface capable of externally accessing flash memories is desirably arranged on electronic music apparatuses so as to easily transfer various kinds of setting information with the flash memories of the electronic music apparatuses handled as open drives.

However, since electronic music apparatuses are of various models, their capabilities differ from model to model. For example, conventional electronic music apparatuses include synthesizers, electronic pianos, electronic organs, and other devices consisting simply a tone generator and an effector or only an effector. In addition, electronic music apparatus models may adopt different methods of generating tones or imparting effects. Therefore, different models require different kinds of setting information. Even if general format of the setting information is common in the same model, individual electronic music apparatuses require different settings in accordance with musical parts for example taken by them.

Consequently, if the setting information of a particular electronic music apparatus is inadvertently set to another electronic music apparatus of a different model or product, problems may be caused that music tone signals could be generated or unintended music tone signals would be generated for example.

A technology is known in which a personal computer is connected to electronic music apparatuses and, when a change in the connection takes place while the power is on, initializes the electronic music apparatus to which the new connection is detected (refer to patent document 1). Namely, the personal computer sends a basic initialization message to the electronic music apparatus connected to the output terminal of the personal computer.

Next, the personal computer sends an identity request to the electronic music apparatus and receives an identity replay therefrom to identify the maker and model for example of this electronic music apparatus. Then, the personal computer sends the optimum initialization data to the identified electronic music apparatus.

However, the above-mentioned prior-art technology only initializes electronic music apparatuses. Therefore, the personal computer cannot transfer and set any setting information edited for each individual electronic music apparatus to that electronic music apparatus.

In the above-mentioned prior-art technology, the electronic music apparatus is not compliant with the USB mass storage class. Therefore, it is difficult for the personal computer to access an internal memory device of the electronic music apparatus. Obviously, the prior-art technology does not consider a counter measure for preventing the malfunction of the electronic music apparatus due to an access error, which might occur when the access to the internal memory becomes easy.

Patent document 1 is Japanese Published Unexamined Patent Application No. Hei 11-212554.

SUMMARY OF THE INVENTION

It is therefore an object of the present invention to provide an editing system of setting information for electronic music apparatuses, an editing apparatus program and an associated electronic music apparatus, which are intended to easily transfer, to the electronic music apparatus, the setting information corresponding to the electronic music apparatus from the editing apparatus externally connected to the electronic music apparatus, and which are intended to prevent the setting information from being inadvertently entered in the electronic music apparatus.

In carrying out the invention and according to one aspect thereof, there is provided a system comprising one or more electronic music apparatus for generating a music tone signal according to play data, and an editing apparatus for editing setting information of each electronic music apparatus. The electronic music apparatus comprises a tone generating section that is settable by setting information to generate a music tone signal in accordance with play data, a memory section that has an open memory area accessible for storing identification information capable of identifying the electronic music apparatus and for storing setting information specific to the electronic music apparatus, an information transfer section that reads out the identification information from the open memory area and sends the read identification information to the editing apparatus, and that receives setting information from the editing apparatus and writes the received setting information into the open memory area, and a setting section operative when the setting information is written into the open memory area by the information transfer section for applying the written setting information to the tone generating section to set the same. The editing apparatus comprises an editing section that can edit setting information of each electronic musical apparatus, a storage section that stores the setting information in association with the identification information of each electronic music apparatus, and a control section that receives the identification information sent from the electronic music apparatus, identifies the electronic music apparatus which sends the identification information according to the received identification information, locates the setting information stored in the storage section in association with the received identification information, and sends the located setting information to the identified electronic music apparatus.

Consequently, the editing apparatus can automatically transfer the setting information corresponding to each electronic music apparatus identified by the identification information (Hereinafter, ID information).

The arrangement of the open memory area in the memory section of each electronic music apparatus allows the direct access by the externally connected editing apparatus generally in the same manner as the internal access to the storage unit within the editing apparatus, thereby significantly simplifying the access to each electronic music apparatus. The above-mentioned memory section having the open memory area can be realized by configuring the electronic music apparatus in compliant with the USB mass storage class.

In the above-mentioned access operation, however, it could happen that data other than the above-mentioned setting information may be erroneously entered from the externally connected editing apparatus or other devices. Even if this actually happens, it is almost unlikely for the tone generating section to erroneously operate or abnormally stop, because the above-mentioned novel configuration does not allow the externally connected editing apparatus or other devices to directly apply the setting information to the tone generating section.

For example, the data transferred and stored in the open memory area are not set to the tone generating section unless they are setting information. In addition, if the ID information associated with this setting information can be known, it is verified whether this ID information is for the electronic music apparatus.

ID information of the electronic music apparatus stored in the open memory area is associated with the setting information stored in the storage section of the editing apparatus. The identification of the electronic music apparatus is performed upon reception by the editing apparatus of the ID information stored in the open memory area of each electronic music apparatus. The transmission of the setting information stored in the storage section of the editing apparatus to the identified electronic music apparatus can be automatically executed at the starting of the editing function of the editing apparatus or when the editing apparatus has completed the editing of the setting information.

When the above-mentioned identification and transmission are executed at the starting of the editing function, the last setting information can be quickly returned to the tone generating section of the electronic music apparatus if the setting information set by the last editing operation is stored in a non-volatile storage unit of the editing apparatus such as a hard magnetic disk. At the same time, a current setting information loaded in the RAM of the editing apparatus can be quickly returned to the last setting information.

When the above-mentioned identification and transmission are executed at the completion of the editing of the setting information by the editing apparatus, the setting information held in the RAM and completed editing can be quickly set to the corresponding electronic music apparatus.

Preferably, in the inventive system, the memory section has a non-open memory area which is not accessible by the information transfer section for storing default setting information which is not edited. The setting section operates when the setting information has not been transferred by the information transfer section to the open memory area for applying the default setting information stored in the non-open memory area to the tone generating section, and operates when the setting information has been transferred by the information transfer section to the open memory area for applying the setting information transferred to the open memory area to the tone generating section.

Consequently, the default setting information stored in the non-open memory area provides the regular setting information which is usually used by the tone generating section. The non-open memory area of the setting information which is usually used by the tone generating section cannot be accessed by the externally connected editing apparatus and therefore the default setting information cannot be erased or overwritten inadvertently by the external access, thereby preventing the electronic music apparatus from operating erroneously.

In carrying out the invention and according to another aspect thereof, there is provided a computer program for use in an editing apparatus connected to one or more electronic music apparatus which has a tone generator settable by setting information to generate a music tone signal in accordance with play data and an open memory accessible for storing identification information capable of identifying the electronic music apparatus and setting information specific to the electronic music apparatus, and which reads out the identification information from the open memory and sends the read identification information to the editing apparatus and receives setting information from the editing apparatus and writes the received setting information into the open memory, and which operates when the setting information is written into the open memory for applying the written setting information to the tone generator to set the same. The computer program is executable by the editing apparatus to perform a method comprising an editing step of editing setting information of each electronic musical apparatus, a storing step of storing the setting information in association with the identification information of each electronic music apparatus in a storage, and a control step of receiving the identification information sent from the electronic music apparatus, identifying the electronic music apparatus which sends the identification information according to the received identification information, locating the setting information stored in the storage in association with the received identification information, and sending the located setting information to the identified electronic music apparatus.

Consequently, the editing apparatus which is used for the electronic music apparatus setting information editing system can be realized by making a computer execute this program.

In carrying out the invention and according to still another aspect thereof, there is provided an electronic music apparatus designed for generating a music tone signal according to play data, and connected to an editing apparatus capable of editing setting information. The inventive electronic music apparatus comprises a tone generating section that is settable by setting information to generate a music tone signal in accordance with play data, a memory section that has an open memory area accessible for storing identification information capable of identifying the electronic music apparatus and for storing setting information specific to the electronic music apparatus, an information transfer section that reads out the identification information from the open memory area and sends the read identification information to the editing apparatus, and that receives setting information corresponding to the sent identification information from the editing apparatus and writes the received setting information into the open memory area, and a setting section operative when the setting information is written into the open memory area by the information transfer section for applying the written setting information to the tone generating section to set the same.

Consequently, the electronic music apparatus which is used for the electronic music apparatus setting information editing system can be realized.

As described, the present invention is advantageous in that the setting information stored in the editing apparatus can be easily transferred to the corresponding electronic music apparatus. The simplified transfer can prevent the data other than the setting information supplied from the externally connected editing apparatus or the like from being set inadvertently to the tone generating section.

In addition, the default setting information which is usually used by the tone generating section cannot be erased or overwritten erroneously by the transfer from the externally connected editing apparatus or the like.

DETAILED DESCRIPTION OF THE INVENTION

Figure 1:
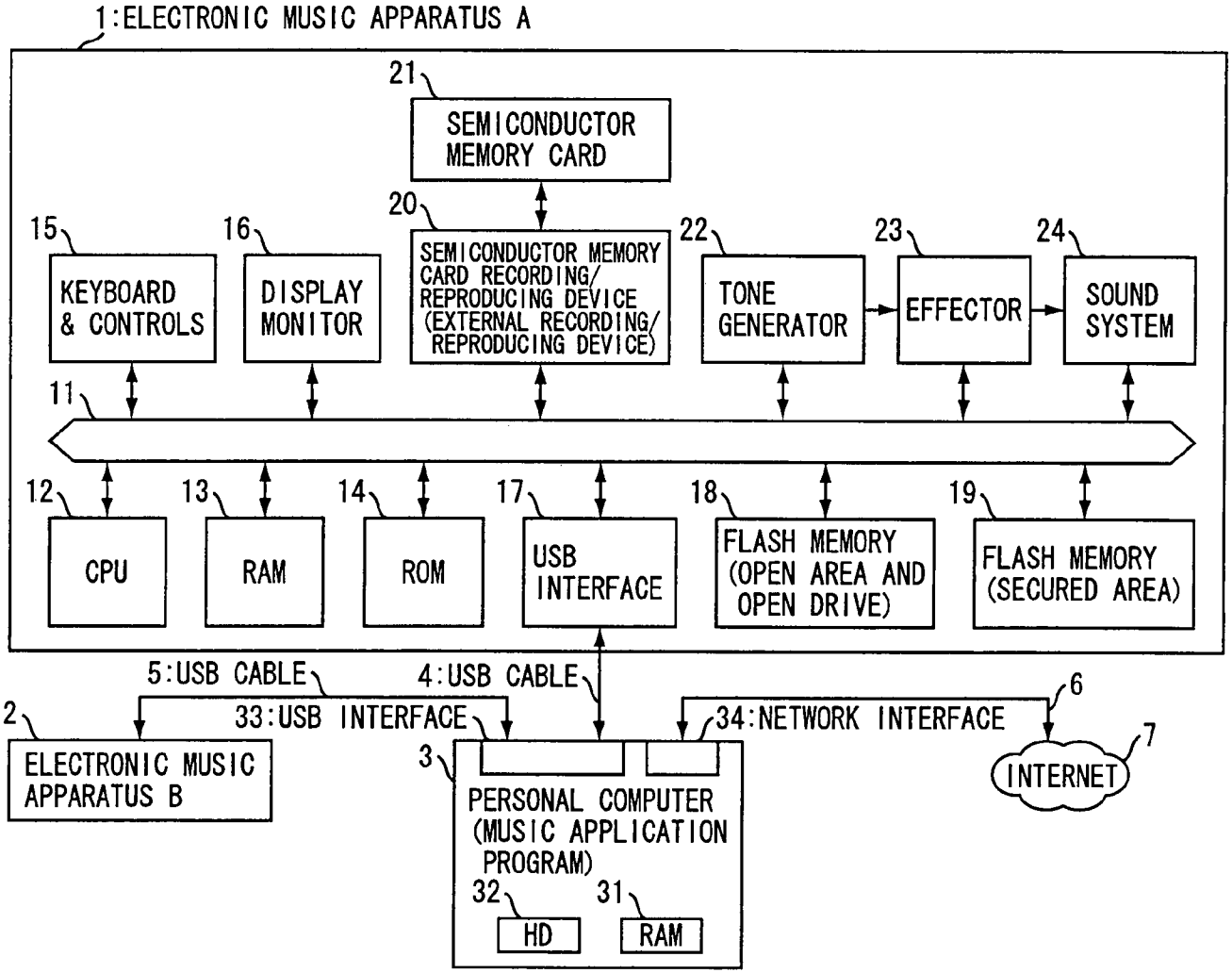
FIG. 1 is a schematic diagram illustrating an electronic music apparatus setting information editing system practiced as one embodiment of the invention.

Now, referring to FIG. 1, there is shown a schematic diagram illustrating an electronic music apparatus setting information editing system practiced as one embodiment of the invention.

In the figure, reference numeral 1 denotes an electronic music apparatus (A), reference numeral 2 denotes an electronic music apparatus (B), and reference numeral 3 denotes a personal computer.

In the personal computer 3, a music software program is installed. When the personal computer 3 is connected to the electronic music apparatus (A) 1 and the electronic music apparatus (B) 2 via USB cables 4 and 5, the personal computer 3 functions as an apparatus for editing the setting information of the electronic music apparatus (A) 1 and the electronic music apparatus (B) 2.

The personal computer 3 is also connected to the Internet 7 via a transmission line 6 to download setting information and music software programs for example.

Depending on the model, the electronic music apparatus (A) 1 and the electronic music apparatus (B) 2 may be different from each other in hardware configuration, but they are the same in basic hardware configuration. Therefore, the following describes the configuration of only the electronic music apparatus (A) 1.

In the electronic music apparatus (A) 1, reference numeral 11 denotes a bus, reference numeral 12 denotes a CPU (Central Processing Unit), reference numeral 13 denotes a RAM (Random Access Memory), and reference numeral 14 denotes a ROM (Read Only Memory).

The CPU 12 controls a keyboard & controls block 15 and a display monitor (liquid crystal display) 16 connected to the bus 11 by use of the RAM 13 as a work area through a control program stored in the ROM 14. The RAM 13 also temporarily stores the music data when automatic play is to be performed, in addition to the current setting information.

Of the keyboard & controls block 15, the keyboard generates such data as key-on, key-off, note number, and velocity. The controls are operated to execute such control operations as menu selection, parameter setting, and automatic play recording/reproducing. Some electronic music apparatuses do not have a keyboard.

The display monitor 16 displays screens in accordance with the functions being executed by the electronic music apparatus.

A USB interface 17 transfers data with the personal computer 3 connected by the USB cable 4.

Reference numeral 18 denotes a flash memory which is an open drive (or an open area) and reference numeral 19 denotes a flash memory which is a non-open are or secured area.

Under the control of the CPU 12, the USB interface 17 accesses a flash memory 18 which is the open area, reads data therefrom, transfers the data to the external personal computer 3, and writes data transferred therefrom to the flash memory 18. At the same time, under the control of the CPU 12, the USB interface 17 prevents the external personal computer 3 from accessing the flash memory 19 which is the secured area.

The above-mentioned flash memory 18 which is an open area is the open drive compliant to the USB mass storage class described above in Prior Art herein, for example. The open drive provides a memory area which can be accessed from the external electronic music apparatus (B) 2. From the personal computer side, the open area can be seen as an open drive, so that only specifying the name of this open drive allows read/write access operations.

Obviously, the CPU 12 incorporated in the electronic music apparatus 1 can access the flash memory 18.

It is practicable to use a part of the memory area of the flash memory 18 as the secured area. In this case, the flash memory 19 which is a secured area need not be arranged.

The open area of flash memory 18 stores ID information for identifying the electronic music apparatus 1 itself and the setting information which is set to a music tone signal generating block composed of a tone generator 22, an effector 23 and a sound system 24.

Reference numeral 20 denotes a semiconductor memory card recording/reproducing device which accesses a semiconductor memory card 21 loaded on this apparatus, thereby executing read/write operations on this memory card.

The semiconductor memory card 21 stores demonstration play data or sample play data, the model data of this electronic music apparatus 1, and the setting information edited in accordance with the product, for example. The semiconductor memory card 21 sometimes stores a control program to be installed on the electronic music apparatus.

The tone generator 22 generates music tones based on the current setting information by processing the play data including the event information corresponding to play operations done through the keyboard & controls block 15 and processing the play data including the event information from the music data such as SMF (Standard MIDI File) stored in the RAM 13 or the semiconductor memory card 21 for example, and outputs the generated music tones to the effector 23.

The effector 23 is implemented by a digital signal processor for example. The effector 23 imparts such effects as reverberation, chorus, and distortion to the music tones generated by the tone generator 22, and supplies the effect-applied tones to the sound system 24. The type and characteristic of each effect to be added depend on parameters which are a kind of the setting information. On the basis of the current setting information supplied via the bus 11, the sound system 24 controls the mixing, sound image panning, and volume level for example of the music tones, thereby generating the final music tones, which are outputted from a speaker.

A MIDI (Musical Instrument Digital Interface) interface interface, not shown, may also be arranged to connect various MIDI devices to the bus 11.

On the other hand, the personal computer 3 may be a general one that has a CPU, a RAM, a ROM, a keyboard, and a mouse for example, to which a display monitor is connected. FIG. 1 only shows a RAM 31, a hard magnetic disk (HD) 32, a USB interface 33, and a network interface 34.

The CPU involved in the personal computer has the capabilities of editing the setting information of the electronic music apparatus (A) 1 and the electronic music apparatus (B) 2, reading and writing the edited setting information on the RAM 31 and the hard magnetic disk (HD) 32, and transferring the setting information to the flash memory 18 which is the open area of the electronic music apparatus (A) 1 or the electronic music apparatus (B) 2.

The above-mentioned flash memory 18 and flash memory 19 retains information after they are powered off. Therefore, these memories may be replaced by any recording media that retain the setting information after the power is turned off. For example, these memories may be substituted by a RAM or a hard magnetic disk drive (HD) which are backed up by batteries.

The semiconductor memory card 21 may be a detachable external recording media such as the CD-ROM (Compact Disc Read Only Memory), for example.

Figure 2A:
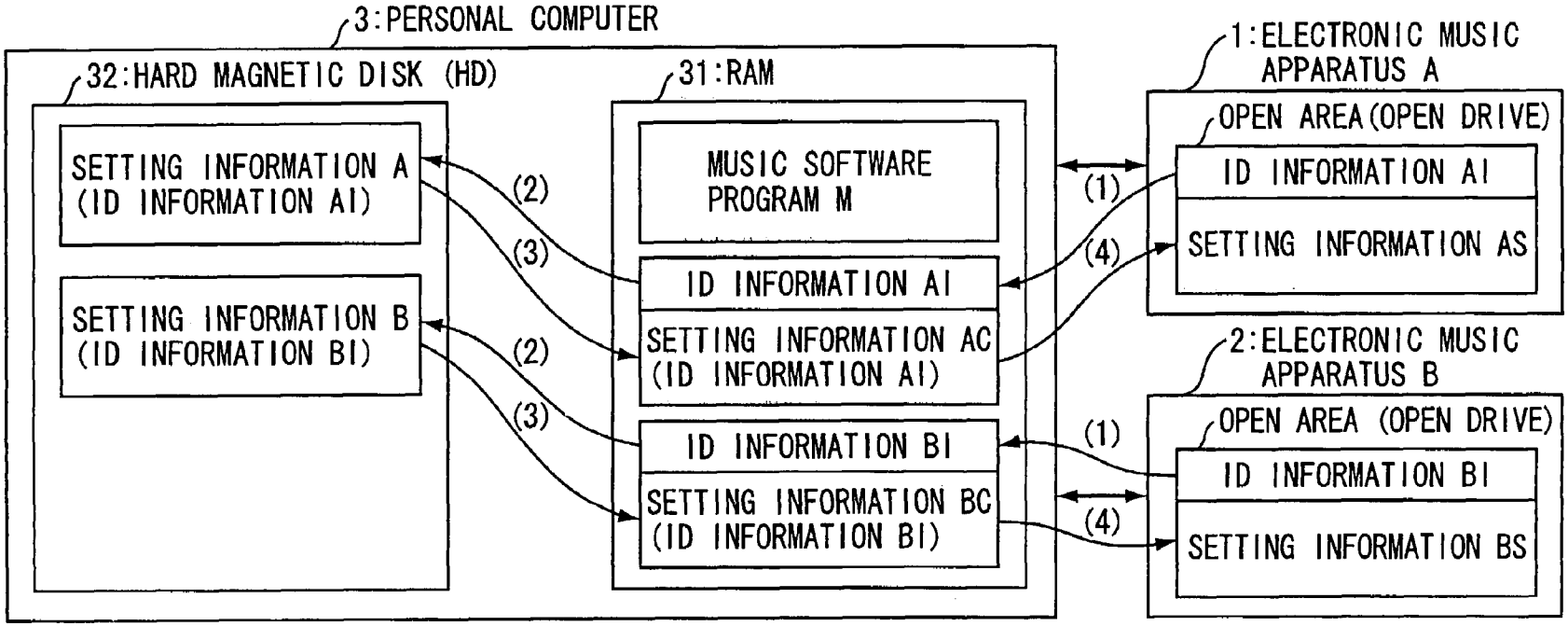
FIGS. 2(*a*) and 2(*b*) are a schematic diagram illustrating transfer scheme of setting information in one embodiment of the invention.
Figure 2B:
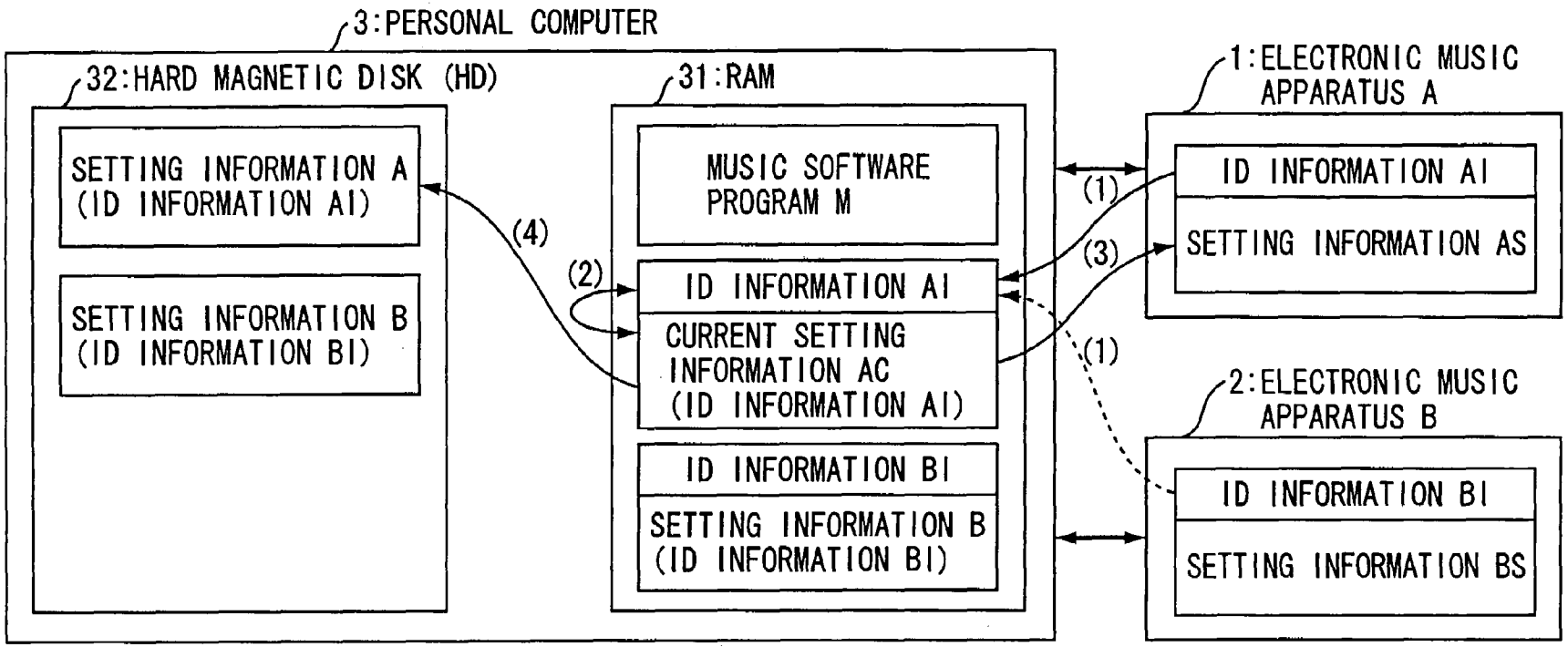

Referring to FIG. 2, there are shown diagrams illustrating flow of setting information in the above-mentioned embodiment of the invention. With reference to FIG. 2, components similar to those previous described with reference to FIG. 1 are denoted by the same reference numerals.

FIG. 2(*a*) shows a state in which the music software program of the personal computer 3 is started with the electronic music apparatus (A) 1 and the electronic music apparatus (B) 2 in the operating state.

The open area (the open drive) of the electronic music apparatus (A) 1 stores ID information (AI) for identifying this electronic music apparatus. It may already store setting information (AS). Likewise, the open area (the open drive) of the electronic music apparatus (B) 2 stores ID information (BI) for identifying this electronic music apparatus. It may already store setting information (BS).

The hard magnetic disk (HD) 32 of the personal computer 3 stores setting information (A) corresponding to the electronic music apparatus (A) associated with ID information (AI) of the electronic music apparatus (A), and setting information (B) corresponding to the electronic music apparatus (B) associated with ID information (BI) of the electronic music apparatus (B).

Setting information (A) and setting information (B) stored in the hard magnetic disk (HD) 32 may be the setting information edited by the editing capability of the personal computer 3 or the setting information obtained from an external recording media or a server on a network.

When a music software program (M) is started in the personal computer 3, this music software program (M) is loaded into the RAM 31. By a part of this music software program (M), the personal computer 3 starts the capability of editing setting information.

It should be noted that, if the music software program (M) executes various other capabilities than editing, the following operations take place when the editing capability is started.

(1) The personal computer 3 accesses the open area (the open drive) of the electronic music apparatus (A) 1, reads ID information (AI) from the open area, transfers the ID information, and stores it into the RAM 31.

(2) The personal computer 3 searches the hard magnetic disk (HD) 32 for setting information (A) associated with this ID information (AI). To be specific, the personal computer 3 determines whether this ID information (AI) matches any of ID information associated with the setting information stored in the hard magnetic disk (HD) 32.

(3) If setting information (A) associated with this ID information (AI) is found stored, the personal computer 3 loads this setting information (A) into the RAM 31 as current setting information (AC).

(4) The personal computer 3 transfers stored current setting information (AC) to the open area (the open drive) of the electronic music apparatus (A) 1 to store it therein as setting information (AS).

Also the personal computer 3 automatically accesses other electronic music apparatus including the electronic music apparatus (B) 2 in the example shown in FIG. 2, executing the operations (1) through (4) described above.

FIG. 2(*b*) shows a state in which the editing of some setting information has been completed by the music software program (M).

It is assumed that the editing of the setting information corresponding to the electronic music apparatus (A) 1 has been completed.

(1) At this point of time, the personal computer 3 automatically reads ID information (AI) from the open area (the open drive) and transfers it to the RAM 31 for temporary storage.

(2) The personal computer 3 determines whether temporarily stored ID information (AI) matches the ID information (AI) associated with the edited current setting information (AC).

(3) If a match is confirmed, the personal computer 3 transfers the current setting information (AC) from the RAM 31 to the open area (the open drive) of the electronic music apparatus (A) 1 which is the destination defined by the ID information (AI) stored in the RAM 31 and stores it as setting information (SA).

It should be noted that, if there is a mismatch between the ID information (AI) associated with the current setting information (AC) and the ID information (AI) of the electronic music apparatus (A) 1, then, in the example shown, the personal computer 3 reads the ID information (BI) from the open area (the open drive) of other electronic music apparatus including the electronic music apparatus (B) 2 on the example shown, transfers the ID information (BI) to the RAM 31 for temporary storage, executes the same comparison, and, if a match is found, transfers the setting information.

(4) The current setting information (AC) loaded in the RAM 31 may be stored back in the hard magnetic disk (HD) 32.

In the example shown, the source of the transfer of ID information (AI) is found to be the electronic music apparatus (A) 1 upon starting of the music software program (M). Therefore, if, subsequently, the relationship of connection between the personal computer 3 and the electronic music apparatus (A) 1 and the electronic music apparatus (B) 2 remains unchanged, it is not necessary to make a comparison between the ID information (AI) associated with the current setting information (AC) and the ID information of one of the electronic music apparatuses upon completion of the editing.

In the above description, it is required to store the setting information in the hard magnetic disk (HD) 32 or the RAM 31 as associated with the ID information.

To do so, the setting information may be one that includes the ID information. When the setting information is described in a file format, the ID information may be included in the file name or in the property information.

Alternatively, an area for storing setting information may be arranged in the storage unit for each ID information.

Figure 3:
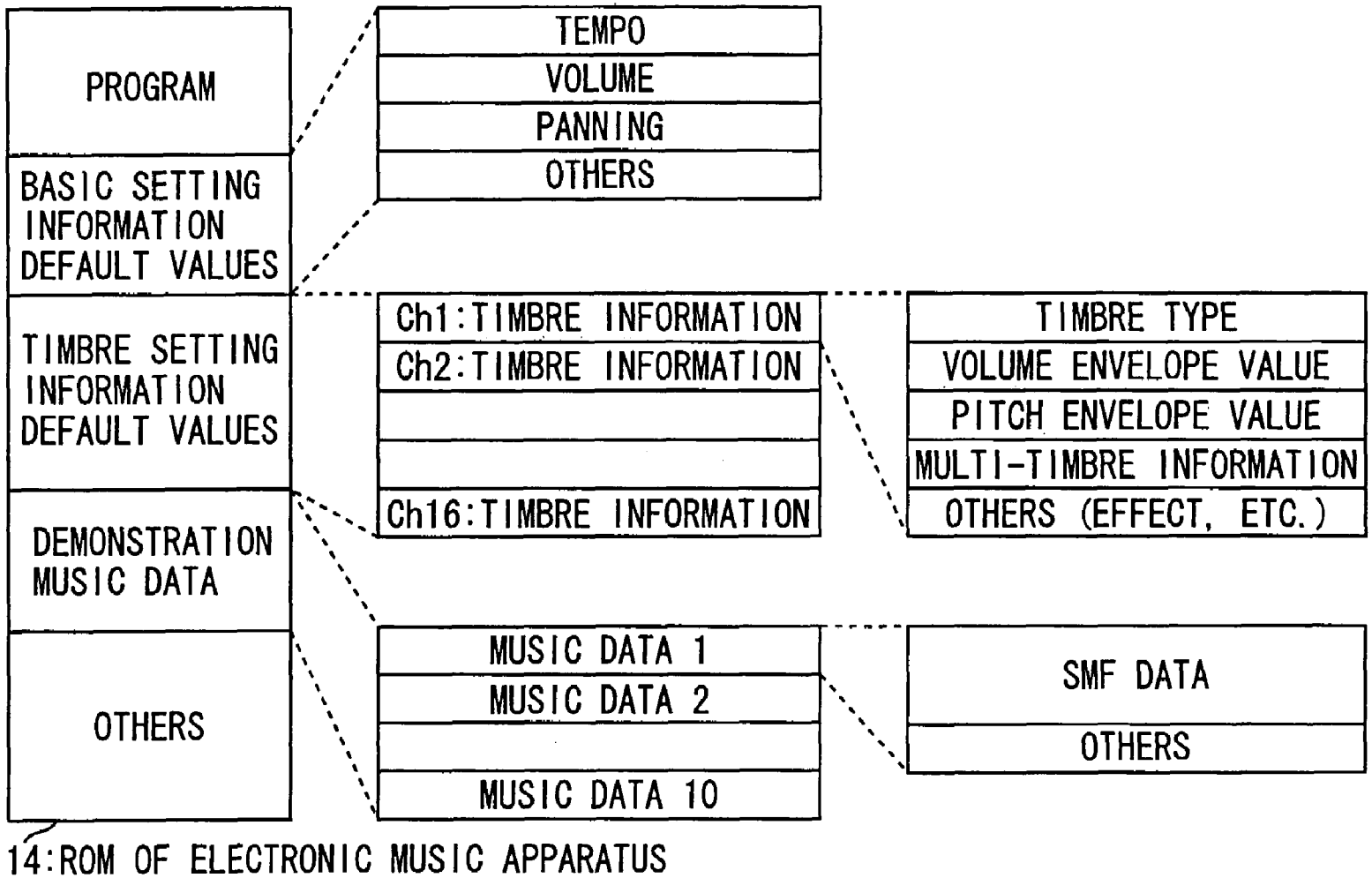
FIG. 3 is a data structure diagram illustrating various pieces of information and programs stored in a ROM of the electronic music instrument practiced as one embodiment of the invention.

FIG. 3 shows a data structure indicative of various information and programs stored in the ROM of each electronic music apparatus in one embodiment of the invention.

The ROM 14 of the electronic music apparatus (A) 1 stores the programs for controlling the electronic music apparatus (A) 1, the default values for basic setting information, the default values for timbre setting information, the data for demonstration, and other information.

The programs may be constituted by the operation system for CPU-incorporated apparatus and application programs which operate under the control of this operating system.

The setting information for the electronic music apparatus (A) 1 is largely classified herein into basic setting information and timbre setting information. However, both may be integrated into one or each may be further divided into smaller units.

The basic setting information is for the basic setting of play; for example, tempo, volume, panning.

The timbre setting information is for setting the timbre of each tone; normally, the timbre setting information is set for each of tone generator channels (ch1 through ch16). For example, the timbre setting information includes parameters such as type of timbre waveform data (musical instrument type), volume envelope value, pitch envelope value, and multi-timbre information (the information for specifying each timbre waveform data when implementing one timbre by two or more timbre waveform data). The effect parameter is included herein in the timbre setting information in a wide sense.

When sampling data such as timbre waveform data are set, these sampling data may be stored as setting information for the transfer to the electronic music apparatus. However, if each electronic music apparatus has many types of sampling data in advance, the numbers of one or more sampling data and the manipulation information for synthesizing or combining these sampling data may only be edited for transfer.

The music data for demonstration is plural pieces of music data for demonstration; for example, SMF data to which the data dedicated to score display may be added.

Figure 4:
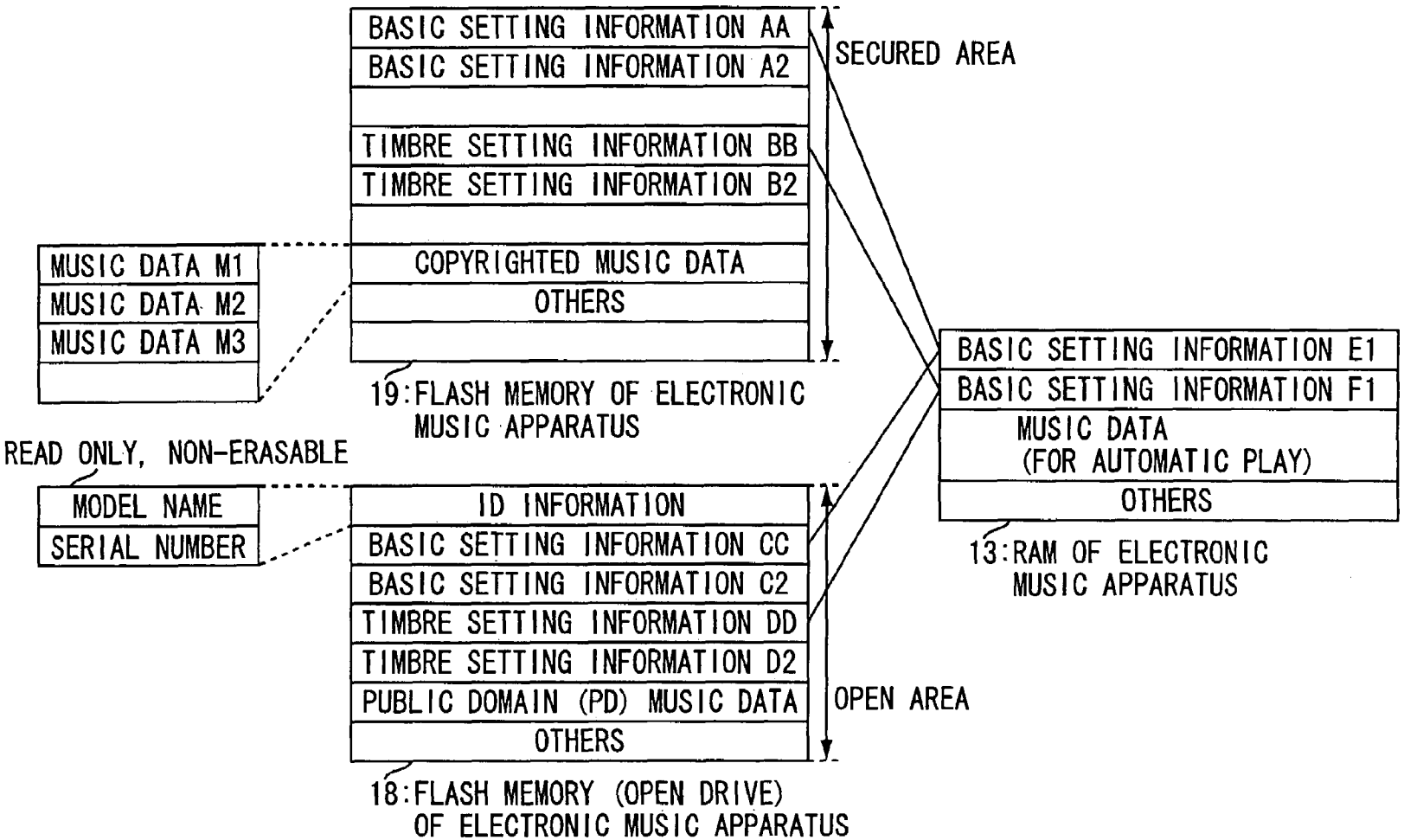
FIG. 4 is a data structure diagram illustrating various pieces of information stored in a RAM and a flash memory of the electronic music apparatus practiced as one embodiment of the invention.

FIG. 4 shows a data structure indicative of various pieces of information which are stored in the RAM and flash memory of each electronic music apparatus in one embodiment of the invention.

The RAM 13 of the electronic music apparatus (A) 1 stores basic setting information E1 and timbre setting information F1. When automatic play is executed, the RAM 13 also stores the music data for this automatic play. In addition, registers necessary for program execution and a buffer area for play data are assigned to the RAM 13.

The secured area of the flash memory (the flash memory 19 in FIG. 1) stores basic setting information AA which is used as default for initialization, basic setting information A2 manually set by the user on the side of the electronic music apparatus (A) 1, and so on. Likewise, the secured area stores timbre setting information BB for initialization, timbre setting information B2 manually set by the user on the side of the electronic music apparatus (A) 1, and so on.

At the time of the initialization after turning on the power to the electronic music apparatus (A) 1, basic setting information AA and timbre setting information BB are loaded from the secured area into the RAM 13 as basic setting information E1 and timbre setting information F1, which are set to the music tone signal generator.

Subsequently, the user can select basic setting information A2 and timbre setting information B2 as desired stored in the secured area by use of the setting controls on the side of the electronic music apparatus (A) 1 and load these pieces of setting information into the RAM 13.

The secured area also stores plural pieces of copyrighted music data M1 through M3 and so on.

On the other hand, the open area of the flash memory (the flash memory 18 in FIG. 1) stores the ID information for identifying the electronic music apparatus (A) 1 itself in the file format called an ID information file. This ID information identifies the electronic music apparatus (A) 1 and the electronic music apparatus (B) 2 currently connected to the personal computer 3 and other electronic music apparatuses which may be connected thereto.

The ID information stored in the open area is desirably stored as a read-only file to prevent deletion or overwriting.

The ID information consists of model name and serial number, for example. Alternatively, an ID unique to each individual electronic music apparatus may be issued by the manufacturer of the electronic music apparatus or the organization of manufacturers.

In the description made above with reference to FIG. 2, the comparison was made between the different pieces of ID information. This comparison need not always be done on the basis of a match between the above-mentioned model names and serial numbers. If the setting information corresponding to that model may only be set, a match between models may be enough. Therefore, the ID information itself may be only a model name.

However, in the case where two or more electronic music apparatuses are used to play in concert, play parts are different and timbre settings are different between the electronic music apparatuses even if their models are the same. If such a situation is supposed, there should be a match between both the model names and serial numbers.

Basic setting information CC and timbre setting information DD are automatically transferred from the personal computer 3 and written to the open area in the RAM 13. When these pieces of setting information have come from the personal computer 3, they are loaded in the RAM 13 to immediately reflect them onto operations.

The basic setting information and the timbre setting information edited by operating the controls on the personal computer 3 can also be transferred to the open area by operating the controls by the user. The above-mentioned basic setting information CC and timbre setting information DD may be stored as basic setting information C2 and timbre setting information D2 which can be distinguished by file property information such as file name.

Subsequently, by operating the setting controls of the electronic music apparatus (A) 1, the above-mentioned setting information can be loaded in the RAM 13 as basic setting information E1 and timbre setting information F1.

In addition, the open area stores PD (Public Domain) music data which are not copyrighted, for example.

Each of the above-mentioned basic setting information and timbre setting information includes a plurality of parameter sets which are stored in a file format for example. Alternatively, each of these pieces of information is configured by pairs of one or more parameter sets, in which each set is stored in a file format for example. In the latter case, the number of sets depends on electronic music apparatuses.

The file name, especially its extension, may be used to identify the basic setting information or the timbre setting information and the parameter type.

In order to make clear the relationship of the basic setting information and the timbre setting information with the electronic music apparatuses, these pieces of setting information may include the ID information described before with reference to FIG. 2. When these pieces of setting information are stored in a file format, the file may include this ID information.

As described above, the electronic music apparatus (A) 1 loads, usually and at the time of initialization, basic setting information AA and timbre setting information BB from the secured area into the RAM 13. These pieces of setting information are loaded into the RAM 13 only when basic setting information CC and timbre setting information DD have been transferred from the personal computer 3 to the open area so as to prevent the data in the open area in which erroneous data may be stored from inadvertently being loaded into 13, thereby preventing the music tone signal generating block from erroneously operating.

When data have come from the personal computer 3, whether the received data are basic setting information CC or timbre setting information DD is determined by a file property such as file name. If basic setting information CC or timbre setting information DD has ID information, a comparison may be made between this ID information and the ID information stored in the open area; if a match is found, the ID information included in these pieces of setting information may be loaded in the RAM 13. When basic setting information CC or timbre setting information DD is loaded in the RAM 13, the ID information may be excluded from it and these pieces of setting information may be not of file format.

Figure 5:
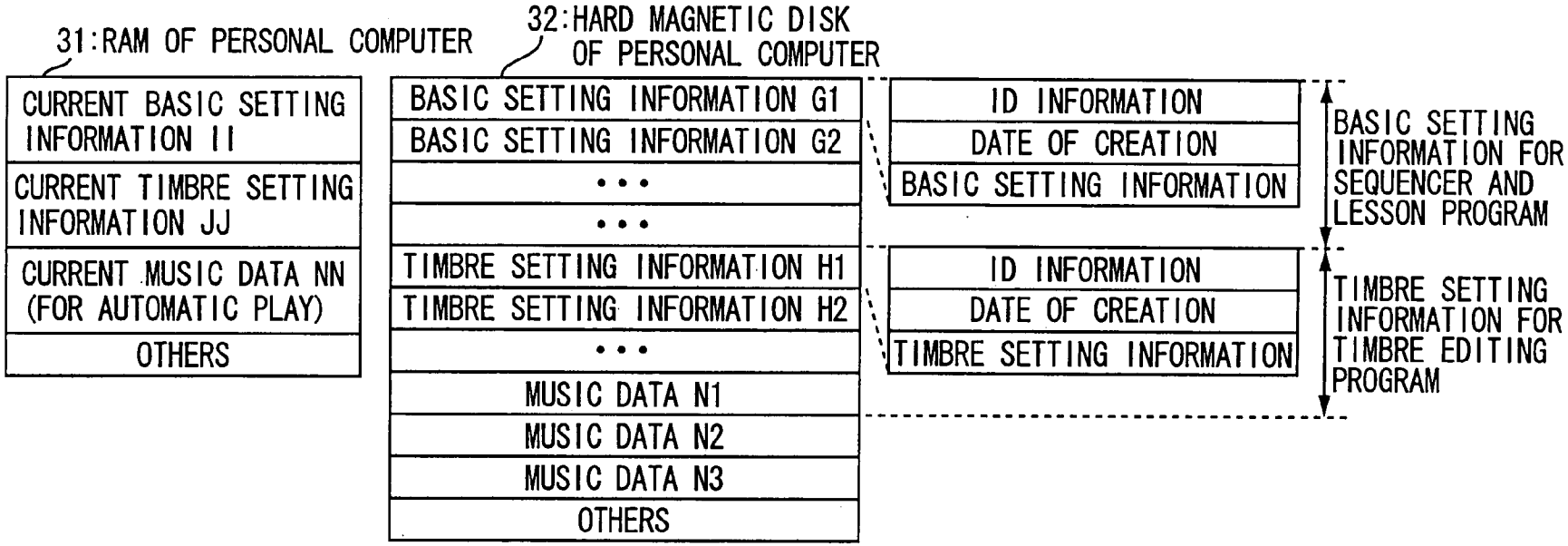
FIG. 5 is a data structure diagram illustrating various pieces of information and programs stored in a RAM and a hard magnetic disk of a personal computer practiced as one embodiment of the invention.

FIG. 5 shows data structures of various kinds of information of programs which are stored in the RAM and the hard magnetic disk of the personal computer.

The RAM 31 of the personal computer 3 stores current basic setting information II, current timbre setting information JJ, current music data NN to be automatically played, the music software program being executed, the operating system program, and so on.

On the other hand, the hard magnetic disk (HD) stores basic setting information (G1), (G2), . . . , timbre setting information (H1), (H2), . . . music data (N1), (N2), . . . , a music software programs, the operating system program, and so on.

For the setting information, various kinds of setting information which were edited and stored in the past can be stored. Also, the setting information obtained from recording media such as CD-ROM and servers on the Internet can be stored.

The basic setting information (for example, G1) and the timbre setting information (for example, H1) are associated with the ID information of the corresponding electronic music apparatus, the electronic music apparatus (A) 1 for example. For example, as described with reference to FIG. 2, the setting information includes the ID information.

In the personal computer 3, the type of the setting information to be edited depends on the type of music software programs.

In the case of sequencer software, for example, music data (or event data) are created and music is edited. The music data of SMF format for example include such setting information for each part as timbre type, effect type, volume, and tempo. Hence, the basic setting information is mainly edited.

In the case of music lesson software, the music data (or event data) associated with the music to lesson also include such setting information for each part as timbre type, effect type, volume, tempo, measure position to lesson, and degree of progress. Hence, the basic setting information is edited.

On the other hand, there is also editor software for setting timbre parameters. This software edits timbre (waveform) type and various parameter values (volume envelope, pitch envelope, velocity curve, multi-timbre type, and so on), and effect type and various parameter values. Hence, the timbre setting information is edited.

Consequently, the setting information to be transferred to the electronic music apparatus vary. In the example shown, one or both of the basic setting information and the timbre setting information are edited and the results of the editing are transferred to the electronic music apparatus. If the setting information is divided further and made independent, only the setting information edited by various music software programs may be transferred.

Figures 6A, 6B, 6C:
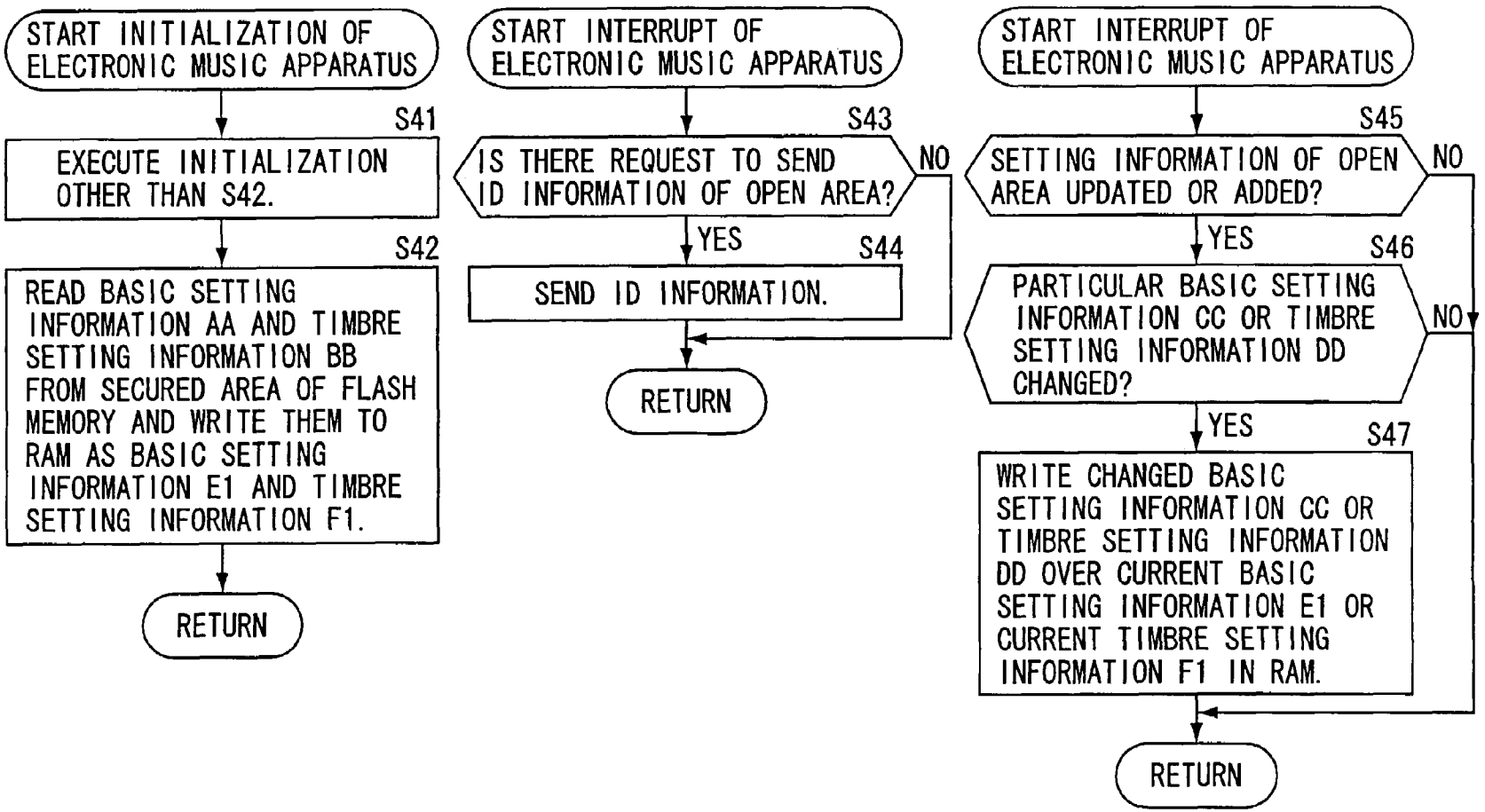
FIGS. 6(*a*), 6(*b*) and 6(*c*) are a flowchart for describing operations of the electronic music apparatus practiced as one embodiment of the invention.

FIG. 6 shows flowcharts for describing operations of the electronic music apparatus practiced as one embodiment of the invention. In what follows, the main flowchart is not shown, with setting operations being described as interrupt handling.

FIG. 6(*a*) is a flowchart for describing an operation which starts when the electronic music apparatus (A) 1 starts.

In step S41, an initializing operation other than S42 is executed.

In S42, basic setting information AA and timbre setting information BB are read from the secured area of the flash memory 18 shown in FIG. 4, which are copied to the RAM 13 as basic setting information E1 and timbre setting information F1 respectively, upon which this routine returns to the main flow.

FIG. 6(*b*) shows a routine which starts upon a timer interrupt with the electronic music apparatus (A) 1 being on.

In step S43, when a request to send ID information stored in the open area comes, this routine goes to S44, in which the ID information is sent to the personal computer, upon which this interrupt ends.

FIG. 6(*c*) shows a routine which starts upon a timer interrupt with the electronic music apparatus (A) 1 being on.

In S45, it is determined whether the setting information in the open area has been updated or added. If the decision is Yes, this routine goes to S46.

In S46, if particular basic setting information CC or timbre setting information DD is found changed, then this routine goes to S47, in which changed basic setting information CC or timbre setting information DD is written over current basic setting information E1 or timbre setting information F1 in the RAM 13, upon which this interrupt ends.

Figure 7:
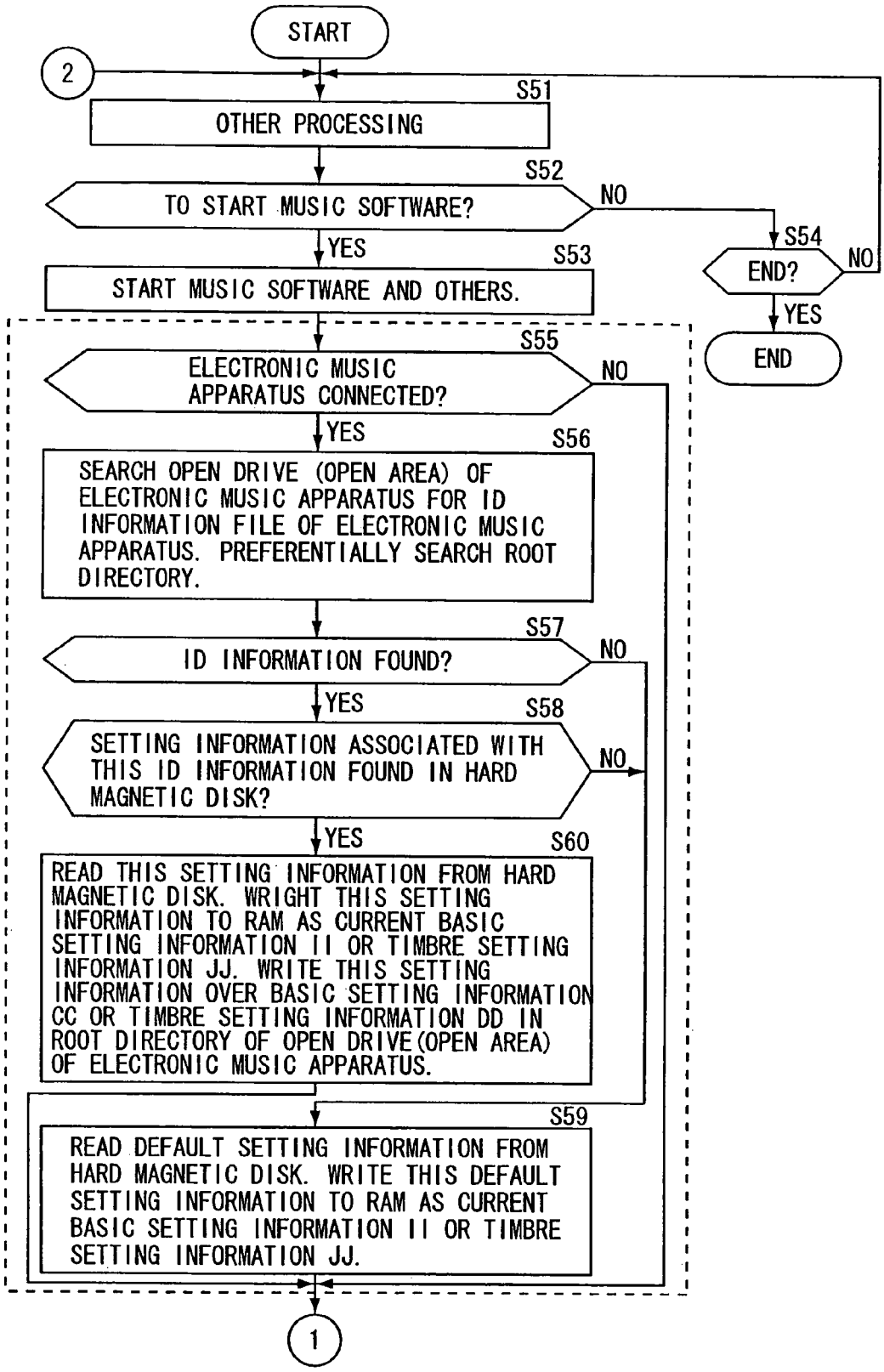
FIG. 7 is a first flowchart for describing operations of the personal computer practiced as the editing apparatus of one embodiment of the invention.

FIG. 7 shows a first flowchart for describing operations of the personal computer practiced as one embodiment of the invention.

In S51, the processing which is not associated with the present invention, namely not associated with music software programs, is executed.

In S52, if the user chooses to start a music software program, the procedure goes to S53; otherwise, the procedure goes to S54. If the user chooses to end the operation of the personal computer, end processing is executed; otherwise, the procedure returns to S51.

In S53, the music software program is started and other associated programs are started, upon which the procedure goes to S55.

Figure 8:
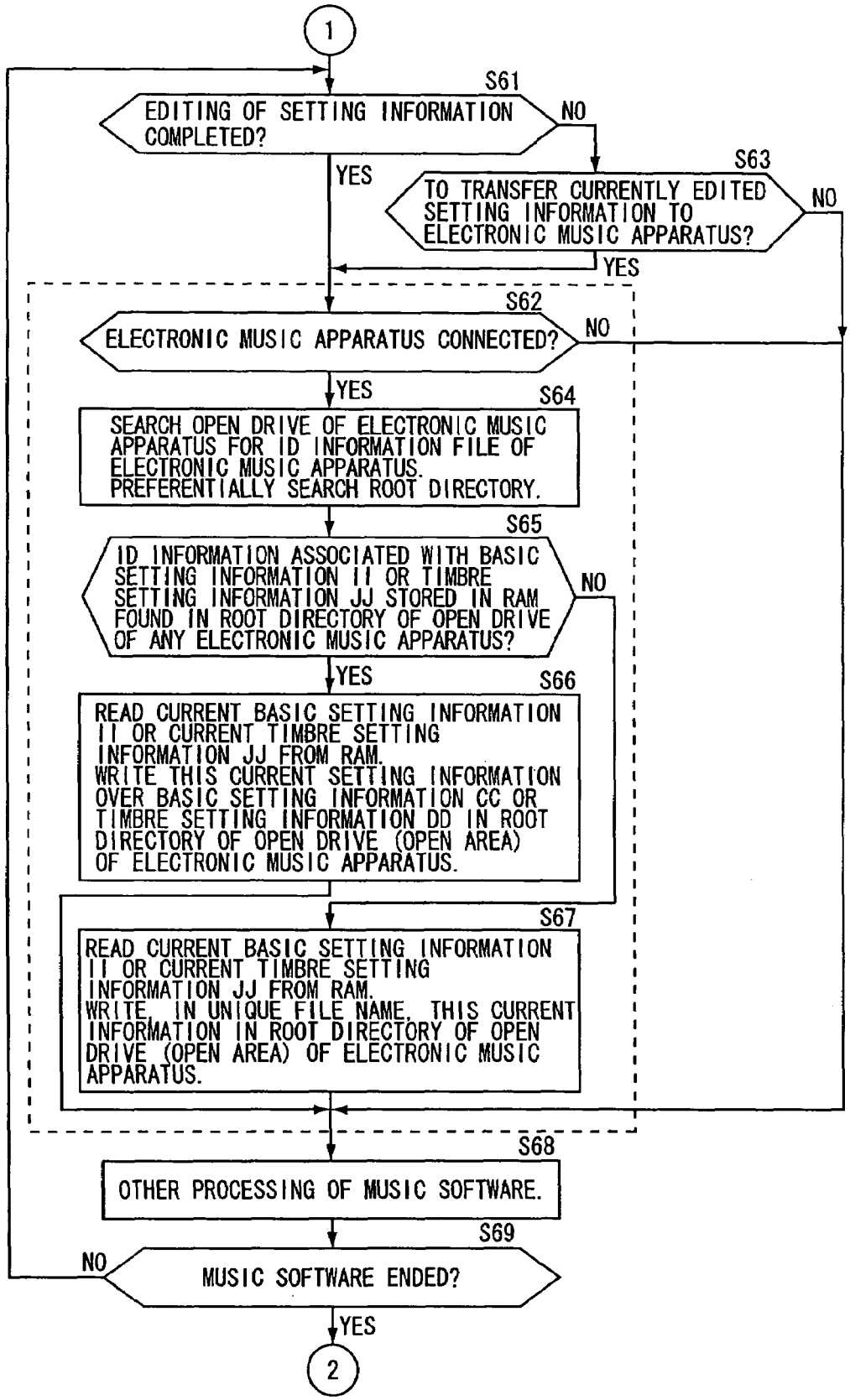
FIG. 8 is a second flowchart for describing operations of the personal computer practiced as the editing apparatus of one embodiment of the invention.

In S55, if it is determined that at least one electronic music apparatus is connected, then the procedure goes to S56; otherwise, the procedure goes to S61 shown in FIG. 8.

The processing operations of S56 through S59 are executed for each of the connected electronic music apparatuses; in what follows, only the processing for the electronic music apparatus (A) 1 will be described for simplicity.

In S56, the open drive of the electronic music apparatus (A) 1 is searched for an ID information file.

The ID information file is arranged in the root directory of the open drive and only a minimum number of files are arranged on this root directory. With the ID information files thus stored, preferentially searching the root directory can shorten the ID information file search time.

Sometimes, two or more open drives are arranged. In such a case, the number of files on the root directory of the open drives in which IF information files are stored may be fixed and the drives having any number of files different from this fixed number be excluded from the search, thereby shortening the ID information file search time.

If ID information is found by the search in step S57, then the procedure goes to S58.

In S58, the memory area of the hard magnetic disk (HD) 32 is searched for any setting information that is associated with this ID information. For example, if basic setting information G1 or timbre setting information H1 is one that is associated with this ID information, then the procedure goes to S60.

In S60, this basic setting information G1 or timbre setting information H1 is read from the hard magnetic disk (HD) 32 and is written to the RAM 31 as current basic setting information II or current timbre setting information JJ. Also, this basic setting information G1 or timbre setting information H1 is written over to basic setting information CC or timbre setting information DD located in the root directory of the open drive (the open area) of the electronic music apparatus (A) 1. If there is none of these pieces of information, basic setting information CC or timbre setting information is newly written.

If the setting information set by the last editing is stored in the memory area of the hard magnetic disk (HD) 32, the personal computer 3 and the electronic music apparatus (A) 1 can be automatically restored to the last setting states described above.

On the other hand, if ID information is not found stored in the open drive in S57 or the setting information assigned with the ID information of the electronic music apparatus (A) 1 is not found stored in the hard magnetic disk (HD) 32 in S58, then the procedure goes to S59.

In S59, basic setting information G1 or timbre setting information H1 for example is read from the hard magnetic disk (HD) 32 as predetermined default setting information and is written to the RAM 31 as current basic setting information II or current timbre setting information JJ.

However, this information is not transferred to the open drive of the electronic music apparatus (A) 1.

After the processing of S59 and S60, the procedure goes to S61 shown in FIG. 8.

FIG. 8 shows a second flowchart for describing operations of the personal computer practiced as one embodiment of the invention.

If the editing job is found completed in S61, then the procedure goes to S62. If the editing job is not found completed, is it determined in S63 whether the setting information is to be transferred to the electronic music apparatus (A) 1 in accordance with user's selective operation. If the setting information is to be transferred to the electronic music apparatus (A) 1, then the procedure goes to S62.

In S62, it is determined whether at least one electronic music apparatus (A) 1 is connected to this personal computer. If the decision Yes, the procedure goes to S64.

In S64, the open drives of the electronic music apparatus (A) 1, the electronic music apparatus (B) 2, and so on are searched for an ID information file.

If, in S65, the ID information associated with edited basic setting information II or timbre setting information JJ stored in the RAM 13 is found in the root directory of the open drive of any one electronic music apparatus, the electronic music apparatus (A) 1 for example, the procedure goes to S66.

In S66, current basic setting information II or current timbre setting information JJ is read from the RAM 31.

Next, the setting information is written over basic setting information CC or timbre setting information DD in the root directory of the open drive of the electronic music apparatus (A) 1.

On the other hand, if the ID information associated with basic setting information II or timbre setting information JJ is not found in the root directory of the open drive of any electronic music apparatuses in S65, then the procedure goes to S67.

In S67, current basic setting information II or current timbre setting information JJ is read from the RAM 31.

Next, at least one electronic music apparatus, the electronic music apparatus (A) 1 for example, is selected in accordance with user's selective operation and a new file name is written to the root directory of the open drive of the selected electronic music apparatus as basic setting information A2 or timbre setting information C2.

In the electronic music apparatus (A) 1, the setting information can be written to the RAM 13 only by user's operation to provide the current setting information. In FIG. 6, the flow corresponding to this processing is omitted.

After completion of the processing of S66 and S67, the procedure goes to S68, in which the other processing of the music software program is executed.

Basic setting information II or timbre setting information JJ stored in the RAM 31 may be kept stored in the hard magnetic disk by user's operation.

In S69, in order to end this music software program by user's operation, the procedure is returned to S51 shown in FIG. 7; otherwise, the procedure is returns to S61.

In the above, the example has been described in which setting information is transferred from the music software program of the personal computer 3 to the electronic music apparatus (A) 1, the electronic music apparatus (B) 2, and so on.

Conversely, in order to transfer setting information from the electronic music apparatus (A) 1 or the electronic music apparatus (B) 2 to the music software program of the personal computer 3, the current setting information, basic setting information E1 or timbre setting information F1 is automatically or in accordance with user's operation to the open drive (the open area). Next, the setting information written to the open drive (the open area) is transferred by the music software program of the personal computer 3 to the RAM 31 and written thereto as current basic setting information II or current timbre setting information JJ.

The above-mentioned electronic music apparatus according to the invention is not restricted to the electronic music instruments or the embodiment of the personal computer in which an application program implementing an electronic music apparatus is installed. For example, the electronic music apparatus may be a karaoke apparatus, a gaming machine, a mobile phone, a PDA (Personal Digital Assistant) or other mobile communication terminals, or an automatic player piano having an electronic tone generator.

If the electronic music apparatus (A) 1 is in the form of an electronic music instrument, it may be of any instrument type, keyboard, string, wind, or percussion.

What is claimed is:

1. A system comprising one or more electronic music apparatus for generating a music tone signal according to play data, and an editing apparatus for editing setting information of each electronic music apparatus, wherein the electronic music apparatus comprises:

a tone generating section that is settable by setting information to generate a music tone signal in accordance with play data;

a memory section that is incorporated in the electronic music apparatus, and has an open memory area accessible from the editing apparatus for storing identification information capable of identifying the electronic music apparatus and for storing setting information specific to the electronic music apparatus, wherein the identification information is stored as read-only information, and wherein the setting information stored may be overwritten;

an information transfer section that reads out the identification information from the open memory area in response to an access from the editing apparatus and sends the read identification information to the editing apparatus, and that receives setting information from the editing apparatus and writes the received setting information into the open memory area; and a setting section operative when the setting information is written into the open memory area by the information transfer section for applying the written setting information to the tone generating section to set the same, and wherein the editing apparatus comprises:

a storage section that stores the setting information corresponding to each of one or more electronic musical apparatus in association with the identification information of each electronic music apparatus;

an editing section that can edit the setting information of each electronic musical apparatus stored in the storage section; and a control section that accesses an electronic musical apparatus connected to the editing apparatus to read the identification information of said electronic music apparatus from the open memory area thereof, identifies said electronic music apparatus according to the read identification information and each identification information associated with the stored setting information of each electronic music apparatus, locates the setting information which is stored in the storage or edited by the editing section and which corresponds to the identified electronic musical apparatus, and access the identified electronic musical apparatus to write located setting information to the open memory area of the identified electronic music apparatus.

2. The system according to claim 1, wherein the memory section has a non-open memory area which is not accessible by the information transfer section for storing default setting information which is not edited, and the setting section operates when the setting information has not been transferred by the information transfer section to the open memory area for applying the default setting information stored in the non-open memory area to the tone generating section and operates when the setting information has been transferred by the information transfer section to the open memory area for applying the setting information transferred to the open memory area to the tone generating section.

3. A computer-readable medium including a program, for causing a computer to perform a method of musical tone editing, said computer connected to one or more electronic music apparatus which has a tone generator settable by setting information to generate a music tone signal in accordance with play data and an open memory externally accessible for storing identification information capable of identifying the electronic music apparatus and setting information specific to the electronic music apparatus, and which operates when the setting information is written into the open memory for applying the written setting information to the tone generator to set the same, the method comprising:

a storing step of storing the setting information corresponding to each of one or more electronic musical apparatus in association with the identification information of each electronic music apparatus in a storage of the computer;

an editing step of editing the setting information of each electronic musical apparatus stored in the storage; and a control step of accessing an electronic musical apparatus to read the identification information of said electronic music apparatus from the open memory thereof, identifying said electronic music apparatus according to the read identification information and each identification information associated with the stored setting information of each electronic musical apparatus, locating the setting information which is stored in the storage and which corresponds to the identified electronic musical apparatus, and accessing the identified electronic musical apparatus to write the located setting information to the open memory of the identified electronic music apparatus.

4. An electronic music apparatus designed for generating a music tone signal according to play data, and connected to an editing apparatus capable of editing setting information, the electronic music apparatus comprising:

a tone generating section that is settable by setting information to generate a music tone signal in accordance with play data;

a memory section that has an open memory area accessible from the editing apparatus for storing identification information capable of identifying the electronic music apparatus and for storing setting information specific to the electronic music apparatus;

an information transfer section that reads out the identification information from the open memory area in response to an access from the editing apparatus and sends the read identification information to the editing apparatus, and that receives setting information corresponding to the sent identification information from the editing apparatus and writes the received setting information into the open memory area; and a setting section operative when the setting information is written into the open memory area by the information transfer section for applying the written setting information to the tone generating section to set the same.

5. An editing apparatus having a machine-readable medium containing a computer program, said editing apparatus connected to one or more electronic music apparatus that has a tone generator settable by setting information to generate a music tone signal in accordance with play data and an open memory externally accessible for storing identification information capable of identifying the electronic music apparatus and setting information specific to the electronic music apparatus, and which operates when the setting information is written into the open memory for applying the written setting information to the tone generator to set the same, the computer program causing the editing apparatus to perform an editing method, said method comprising:

a storing step of storing the setting information corresponding to each of one or more electronic musical apparatus in association with the identification information of each electronic music apparatus in a storage of the computer;

an editing step of editing the setting information of each electronic musical apparatus stored in the storage; and a control step of accessing an electronic musical apparatus to read the identification information of said electronic music apparatus from the open memory thereof, identifying said electronic music apparatus according to the read identification information and each identification information associated with the stored setting information of each electronic musical apparatus, locating the setting information which is stored in the storage and which corresponds to the identified electronic musical apparatus, and accessing the identified electronic musical apparatus to write the located setting information to the open memory of the identified electronic music apparatus.

* * * * *